US005700156A

United States Patent [19]

Bussard et al.

[11] Patent Number: 5,700,156

[45] Date of Patent: Dec. 23, 1997

[54] ELECTRICAL CONNECTOR WITH WIRE RESTRAINT

[75] Inventors: John Rudell Bussard, Kernersville; Garold Michael Yurko, Greensboro, both of N.C.

[73] Assignee: The Whitaker Corporation, Delaware, Del.

[21] Appl. No.: 690,684

[22] Filed: Jul. 31, 1996

[51] Int. Cl.[6] ..... H01R 13/58

[52] U.S. Cl. ..... 439/471

[58] Field of Search ..... 439/471, 464, 439/465–468, 473

[56] References Cited

U.S. PATENT DOCUMENTS

| | | | |
|---|---|---|---|
| 3,603,913 | 9/1971 | Hasty, Jr. | 439/471 |
| 3,803,530 | 4/1974 | Lapraik | 439/471 |
| 3,936,129 | 2/1976 | Guy | 339/103 R |
| 4,108,527 | 8/1978 | Douty et al. | 339/107 |
| 4,341,431 | 7/1982 | Woratyla | 339/103 M |
| 4,358,178 | 11/1982 | Guy | 339/103 R |
| 4,448,471 | 5/1984 | Berry et al. | 339/91 R |
| 4,606,596 | 8/1986 | Whiting et al. | 339/107 |
| 4,640,984 | 2/1987 | Kalbfeld | 439/465 |
| 4,842,549 | 6/1989 | Asick et al. | 439/464 |
| 5,055,066 | 10/1991 | Garretson | 439/464 |
| 5,211,706 | 5/1993 | Polgar | 439/464 |

*Primary Examiner*—Gary F. Paumen

[57] ABSTRACT

An electrical connector 6 includes a wire restraint arm 20 extending from one side of a connector body 8. Wires 2 connected to terminals 4 in this connector 6 are positioned on an exposed concave or V-shaped surface of this wire restraint arm 20. The wire restraint arm 20 provides both strain relief and isolates the terminals 4 from external vibration or motion of the wires 2. A central wire restraint section 32 is located between an inner lip 28 and an outer lip 30 that are wider and taller than the central section 32 to form a gap 26 at least partially surrounding the central section. A conventional wire tie 50 is held in this gap with the wire tie encircling both the wire bundle and the central wire restraint section 32. Ribs 40, 42, and 44 located on the central section 32 and the lips 28, 30 grip the wire insulation, and wires on the exterior of the wire bundle engage either the ribs or the cable tie. Wire bundles of different sizes can be accommodated.

18 Claims, 6 Drawing Sheets

ELECTRICAL CONNECTOR WITH WIRE RESTRAINT

BACKGROUND OF THE INVENTION

1. Field of the Invention

This invention relates to an electrical connector including stress or stain relief means or a wire restraint for wires exiting the electrical connector in which a pliant, conductor encircling strap, such as a conventional cable tie, is used to grip the wire.

2. Description of the Prior Art

In many conventional applications it is necessary to include a wire strain relief in an electrical connector. Typically strain relief is necessary to prevent forces applied to the wires from damaging the interconnection of the wire to the electrical terminal used in the connector. For example, the application of a tensile force to a wire may cause damage to the termination of that wire. In some extreme cases, the termination is destroyed and in others the wire is broken. Even in cases were such catastrophic damage does not occur initially, damage to the termination can result in long term deterioration to the electrical connection. The termination may be exposed and oxides can form causing an increase in termination resistance. Where the termination is repeatedly stressed, fatigue can occur at the termination eventually resulting in complete failure of the termination. These problems are especially significant when dealing with small wires used for electrical signal as opposed to electrical power distribution. In the first case, the strength of small signal wire is less and since the electrical signal levels are relatively small, any increase in resistance causes relatively greater signal distortion.

One conventional technique for providing strain relief in an electrical connector is to employ mating connector housing sections that engage wires. In some cases separate inserts are added to accommodate cables having a wide variety of cross-sectional areas. One example of such connectors is U.S. Pat. No. 4,108,527.

Other connectors use pliant, conductor encircling straps to engage the wires or bundles of wires. In some cases these flexible straps are integrally molded parts of the connector housing. In other cases conventional wire ties are used. Examples of prior art electrical connectors using conventional wire ties include the following: U.S. Pat. No. 4,341,431; U.S. Pat. No. 4,358,178; U.S. Pat. No. 4,448,471; and U.S. Pat. No. 4,842,549.

In some applications, strain relief or wire restraint is important because forces other than axial forces can be applied to wires and transmitted to the electrical connection. For example, vibration can be a problem in automotive applications. While vibration may not adversely affect the termination of wires to terminals it can be a problem with mating connectors. Vibration can affect the electrical interface between female receptacle contacts and mating pins. Wire restraint is important in such applications because vibration can be transmitted through the wires to the electrical interface between mating terminals. One example of an electrical connector using a flexible strap to secure wires is shown in U.S. Pat. No. 5,055,066, which shows a connector used in an electrically controlled automobile transmission.

SUMMARY OF THE INVENTION

The electrical connector and wire restraint disclosed by the representative and preferred embodiment disclosed herein addresses the problems discussed in the prior art and problems associated with the use of electrical connectors in automotive applications.

Among the objectives addressed by this invention are to provide an electrical connector that can be efficiently, reliably and economically used in automotive applications, especially for use with electrically or electronically controlled transmission systems in automobiles where vibration of the wires is common.

Another objective is the use of simple conventional cable ties that can be easily applied during conventional assembly operations with wire bundles of different sizes.

This invention also permits the wires in a cable harness to be attached to an exposed, accessible portion of an electrical connector.

These and other objectives are addressed by the invention disclosed herein.

The electrical connector includes a wire restraint or strain relief that includes a wire restraint arm extending from a connector body. The wire restraint arm includes a central wire restraint section having an inner lip and an outer lip on opposite sides. The wire restraint arm has a concave or V-shaped upper surface on which the wires can be positioned. The inner lip and the outer lip are wider and taller than the central wire restraint section so that a gap is formed between the lips and at least partially around the central wire restraint section. This gap is wide enough to receive a conventional cable tie that encircles both the central wire restraint section and the wires supported by this section. Both the central wire restraint section and the lips can include ribs on the upper surface to more completely secure the wires in position.

An electrical connector employing a wire restraint arm of this type includes a connector body having terminal receiving cavities in which terminals attached to the wires are positioned. The wire restraint arm can extend from one side of the connector body. In one application this wire restraint arm extends transversely relative to the terminals so that the wires are bent through an angle between the terminal and the point at which the wires are attached to the wire restraint arm.

A connector employing this invention can use terminals having a receptacle section forming a mating electrical interface with pins extending from a mating electronic component. The receptacle section is typically located at the mating end of the connector and the wire restraint arm is located at an opposite end of the connector. Wires extending from the terminals to the wire restraint section can thus be isolated from movement. These portions of the wires are gathered or funneled in the connector into a bundle that can be positioned on the wire restraint arm where a conventional cable tie can be applied. Wire bundles of different sizes can be accommodated.

BRIEF DESCRIPTION OF THE DRAWINGS

FIG. 5 shows only the connector body, section lines 3—3 and 4—4 for FIGS. 3 and 4 respectively are shown on this figure despite the fact that FIGS. 3 and 4 are for the connector and not the connector body.

DETAILED DESCRIPTION OF THE PREFERRED EMBODIMENT

Figure 1:
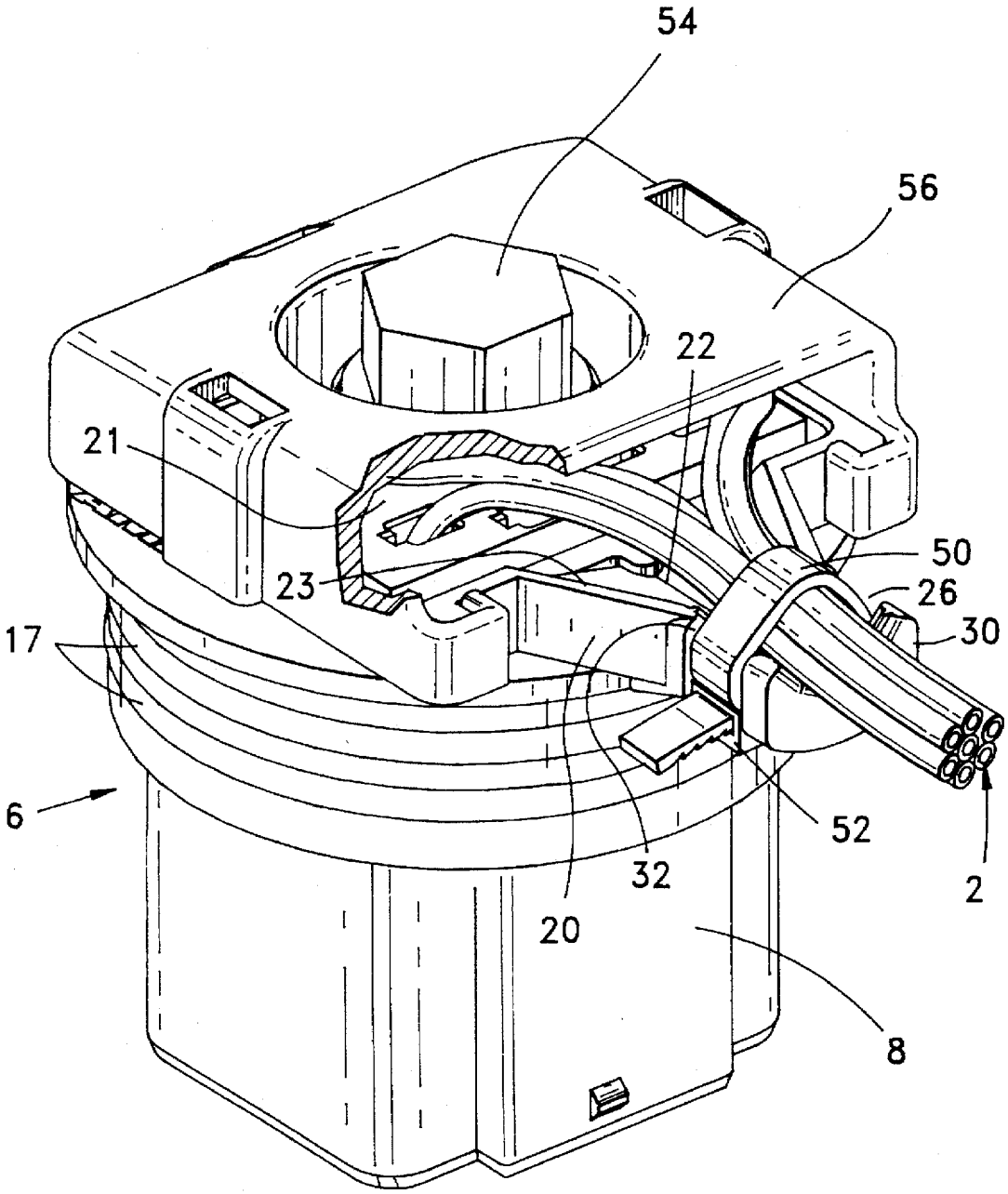
FIG. 1 is a perspective view of an electrical connector and a wire restraint arm extending from one side of the electrical connector body. Portions of the connector cover are broken away to show wires entering the connector.

The preferred embodiment of the electrical connector 6 is used to connect a plurality of wires 2 in a harness to an electronic or electrical component. This connector 6 is especially adapted for use in an automotive electrical system and is primarily intended for use with an electronic transmission control system in an automobile. The electrical connector 6 includes a plurality of electrical terminals 4 positioned within terminal receiving cavities 14 in an insulating connector housing body 8 molded from a conventional thermoplastic material. Connector body includes a mating section 10 located at the bottom of the connector body 8 and an upper wire entry section 12. Terminal receiving cavities 14 extend between the mating section 10 and the wire entry section 12. The terminals 4 are conventional and include a receptacle section 46 and a wire contact or crimp section 48 located at the opposite ends of the terminals. A cantilever terminal latch beam 15 of conventional construction extends from the connector body 8 into each terminal cavity 14 to engage the terminal receptacle section 46 to secure each terminal 4 in its respective terminal receiving cavity 14. The receptacle section 46 is intended to mate with a conventional contact pin extending from an external electrical or electronic component and is typically used to establish an electrical interface with pins in a conventional pin header. Both the pins and the receptacle section 46 can be conventionally plated with either a non-noble plating such as tin or with a noble plating to improve the performance of the electrical interface. Although the wire contact section 48 of this terminal is a conventional crimp section, other conventional wire contact sections, such as an insulation displacement contact section could be employed.

Figure 3:
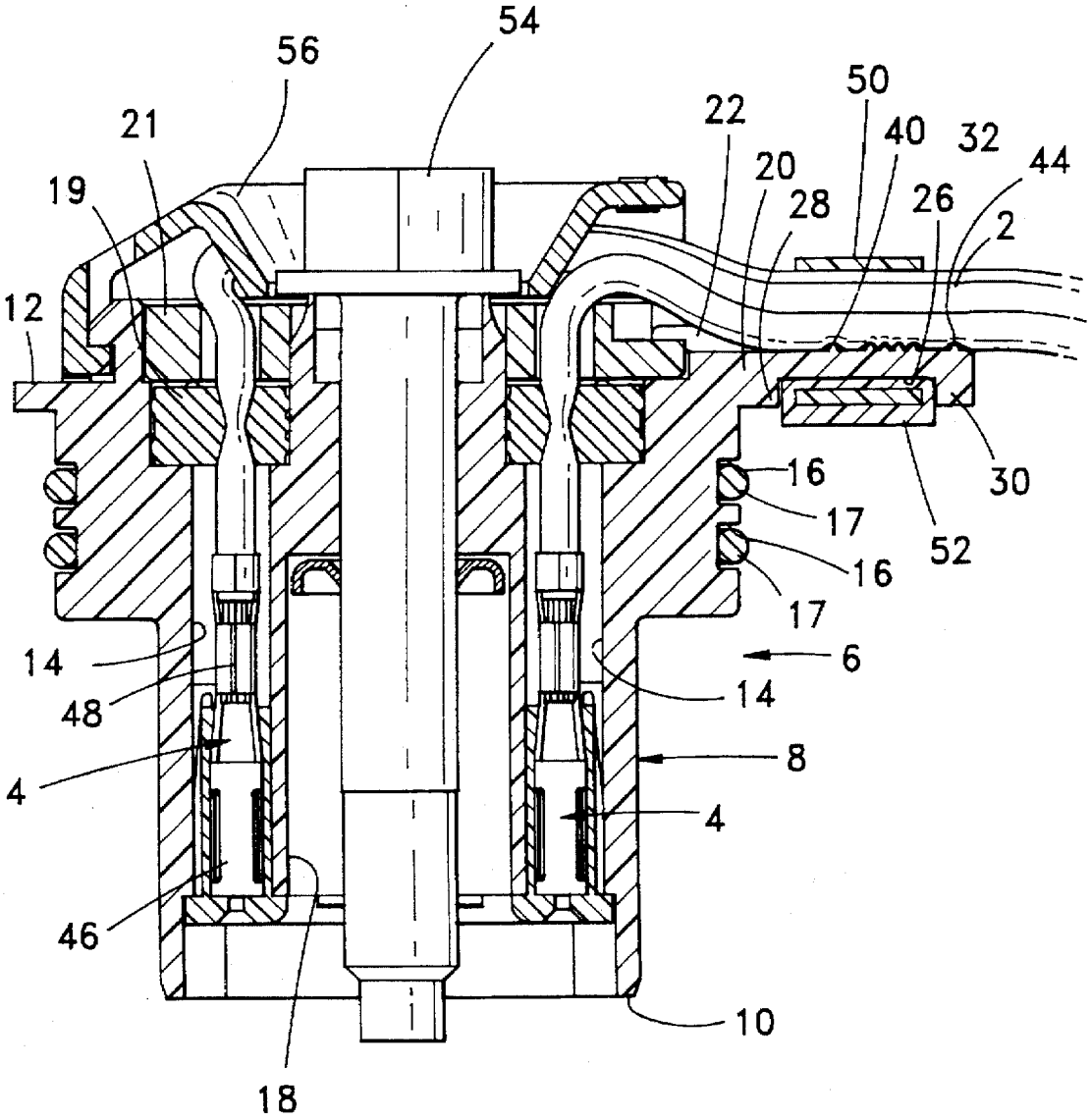
FIG. 3 is a sectional view taken along section lines 3—3 showing wires connected to terminals positioned in the electrical connector body and secured to the wire restraint arm.
Figure 4:
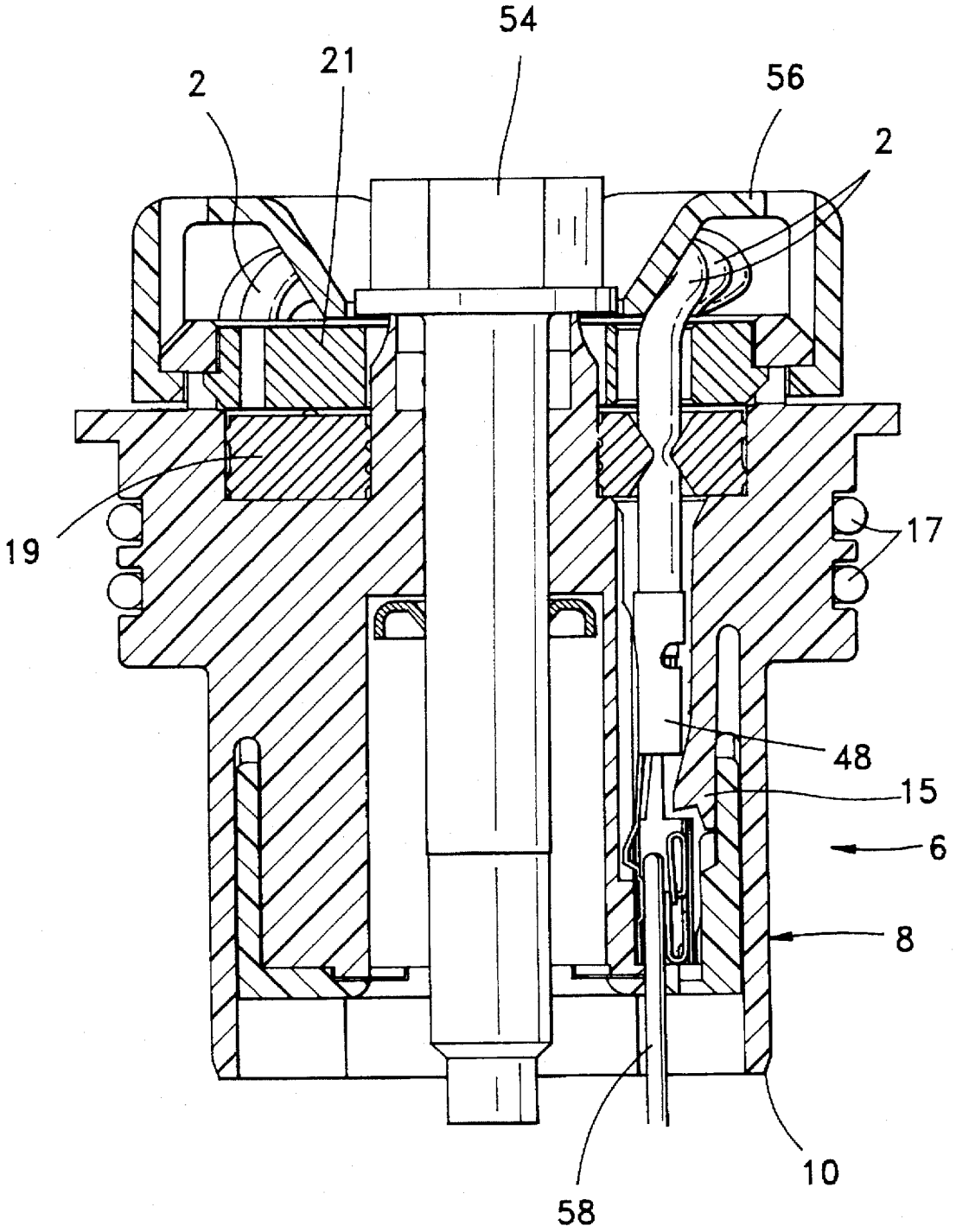
FIG. 4 is a section view taken along section lines 4—4 showing the terminals receptacle and the electrical interface formed between the terminal receptacle and contact pins extending from the electrical component with which the electrical connector and wires are to be used.

The electrical connector 6 also includes a wire restraint arm or section 20 extending from one side of the connector body 8. This wire restraint section 20 is located at the top of the connector body 8 and is integrally molded as a part the connector body 8. As shown in FIG. 1, this wire restraint section 20 extends beyond a cover 56 that is attached to the top of the connector body 8. Wires 2 extend from beneath the cover 56 and are secured to the wire restraint arm 20 by a conventional wire tie 50 which encircles both the bundle of wires 2 and a section of the wire restraint arm 20 on which the wires 2 are positioned. This wire restraint arm and the wire tie 50 serve not only as a strain relief or stress relief to prevent damage to the termination of each wire to the wire contact section 12 of the corresponding terminal 4 but also isolate any external forces applied to the wires 2 from the terminals 4 and the electrical interface between terminal receptacle 46 and mating pins 58 in the mating electronic or electrical component. See FIGS. 3 and 4. Vibration or other movement of the wires, which is common in automotive applications, will therefore be isolated from the terminals 4 and from the terminal-pin electrical interface so that small movement of the terminals relative to the pins, which can adversely affect the performance of the electrical interface, is avoided, eliminated or reduced.

Figure 2:
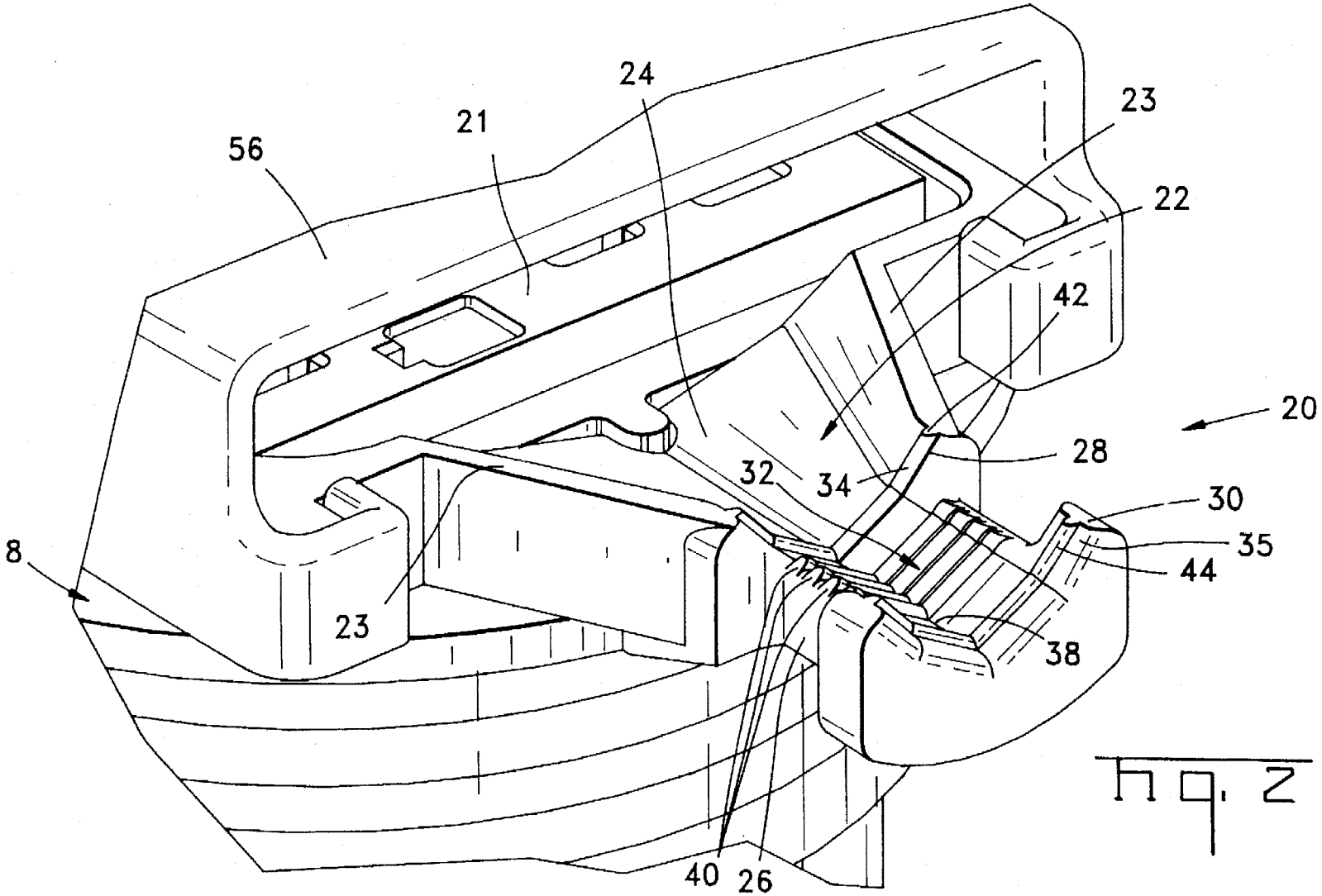
FIG. 2 is an enlarged perspective view of the wire restraint arm.
Figure 6:
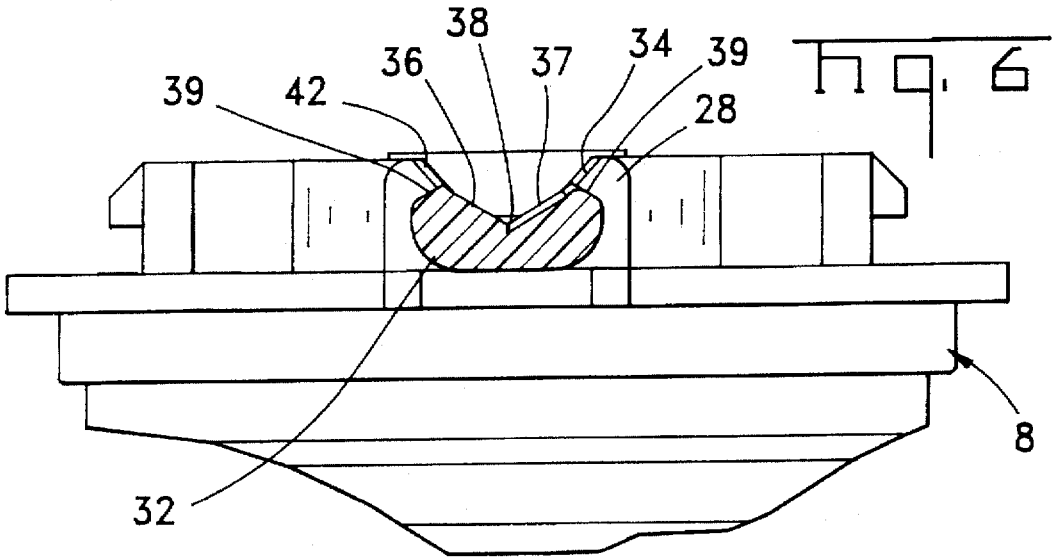
FIG. 6 is a sectional view through the central wire restraint section of the wire restraint arm.
Figure 7:
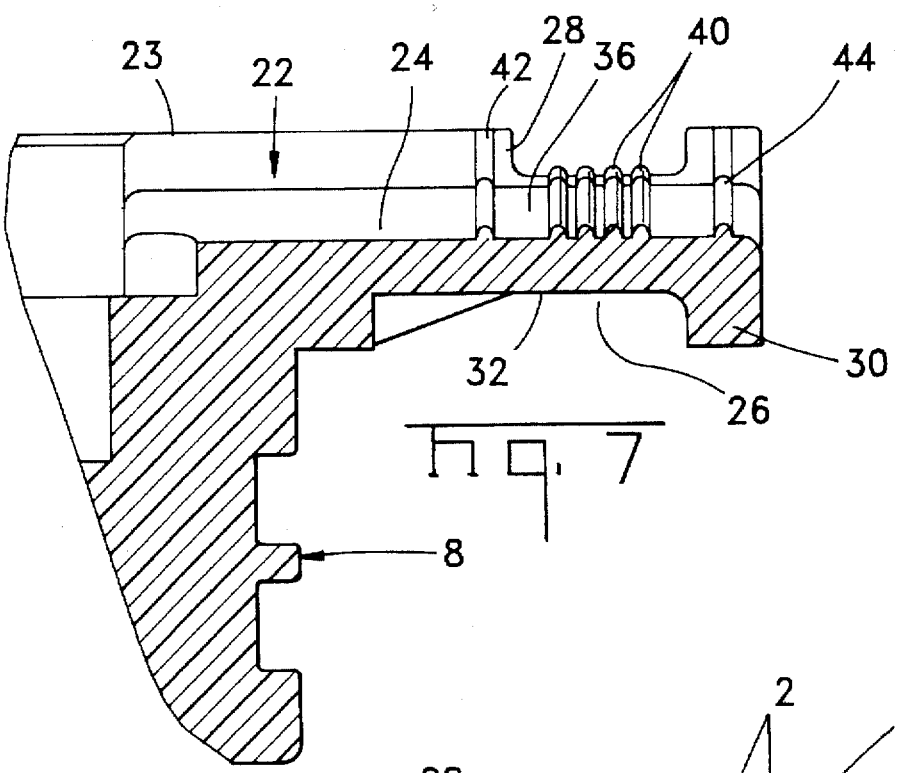
FIG. 7 is a side sectional view of the wire restraint arm.

Details of the wire restraint arm 20 are shown in FIGS. 2, 6 and 7. Wire restraint arm 20 is cantilevered from the top of the connector body 8. A funnel section 22 tapers inwardly from the base of the wire restrain arm 20 and serves to gather the wires extending from the terminals 4 located in the connector body 8. Funnel 22 is at least partially exposed and extends beyond cover 56. This funnel or trough 22 is formed by inwardly tapering sidewalls 23 and two mutually inclined bottom walls 24 which form a V-shaped cross section. An inner flange or lip 28 is located at the narrow end of the funnel section 22. A central or intermediate section 32 is located between the inner lip 28 and an outer lip 30. Both the inner and outer lips 28, 30 are wider than the central section 32 and each lip extends above the central section. A gap 26 is thus formed between the inner lip 28 and the outer lip 30 around the central section 32. This gap 26 provides a space for a cable tie 50 encircling the wires 2 and the central section 32 to secure the wires 2 to the wire restraint arm 20. Central wire restraint section 32 is the narrowest part of wire restraint arm 20, but it will have a width greater than the width of the wire bundle containing the largest number of wires, of the largest diameter, that can be accommodated by the connector 2.

The central section 32 of the wire restraint arm 20 is V-shaped in cross section as best shown in FIG. 6. Two upwardly facing lower surfaces 36, 37 are mutually inclined and extend upwardly and outwardly at an acute angle from vertex 38. Inclined face 34 on first lip 28 and inclined face 35 on second lip 30 extend upwardly beyond the inclined faces 36, 37 of the central section arm section 32, and these lip faces 34, 35 are angled relative to the inclined faces 36, 37 of the central section 32 so that lip faces 34, 35 are steeper. These steeper faces 34, 35 help gather the wires extending from the terminals 4 in the connector body 8 into a bundle so that these wires may be secured by the central wire restraint arm section 32 and the cable tie 50 encircling the wires 2 and the central arm section 32. Shorter, steeper inclined sections are also located at the upper edges of the inclined faces 36, 37 of the central arm section 32. Although faces on the lips and central section are planar and inclined in the preferred embodiment, it should be understood that these surfaces define a concave upwardly facing structure and these inclined faces need not be planar as in the preferred embodiment, but could be curved or could define other equivalent concave surfaces. The upwardly directed inclined faces of the lips 28 and 30 merge with the V-shaped exposed faces of the central wire restraint section 32.

Raised ribs extending transverse to the centerline of the wire restraint arm 20 are located on the first or inside lip 28, the central or intermediate arm section 32 and on the second or outside lip 30. Ribs 40, 42, 44 extend above the upwardly facing planar faces on the central rib 32 and on the first and second lips 28, 30. A single radiused rib 42 and one radiused rib 44 are located on the inner lip 28 and the outer lip 30 respectively. A plurality of radiused ribs 40 are located on the center arm section 32 to form a grooved surface. These ribs 40, 42 and 44 will engage the outer insulation on wires 2 positioned on the wire restraint arm 20 and will grip those wires in direct contact with the wire restraint arm 20 to prevent movement of these wires 2. Although straight, continuous ribs 40, 42, 44 extend transversely between the edges of the lips and central arm section, it should be understood that similar enhanced gripping means could be employed. For example raised bumps, diamonds or a roughened or adhesive surface could be used in equivalent alternative embodiments.

Figure 5:
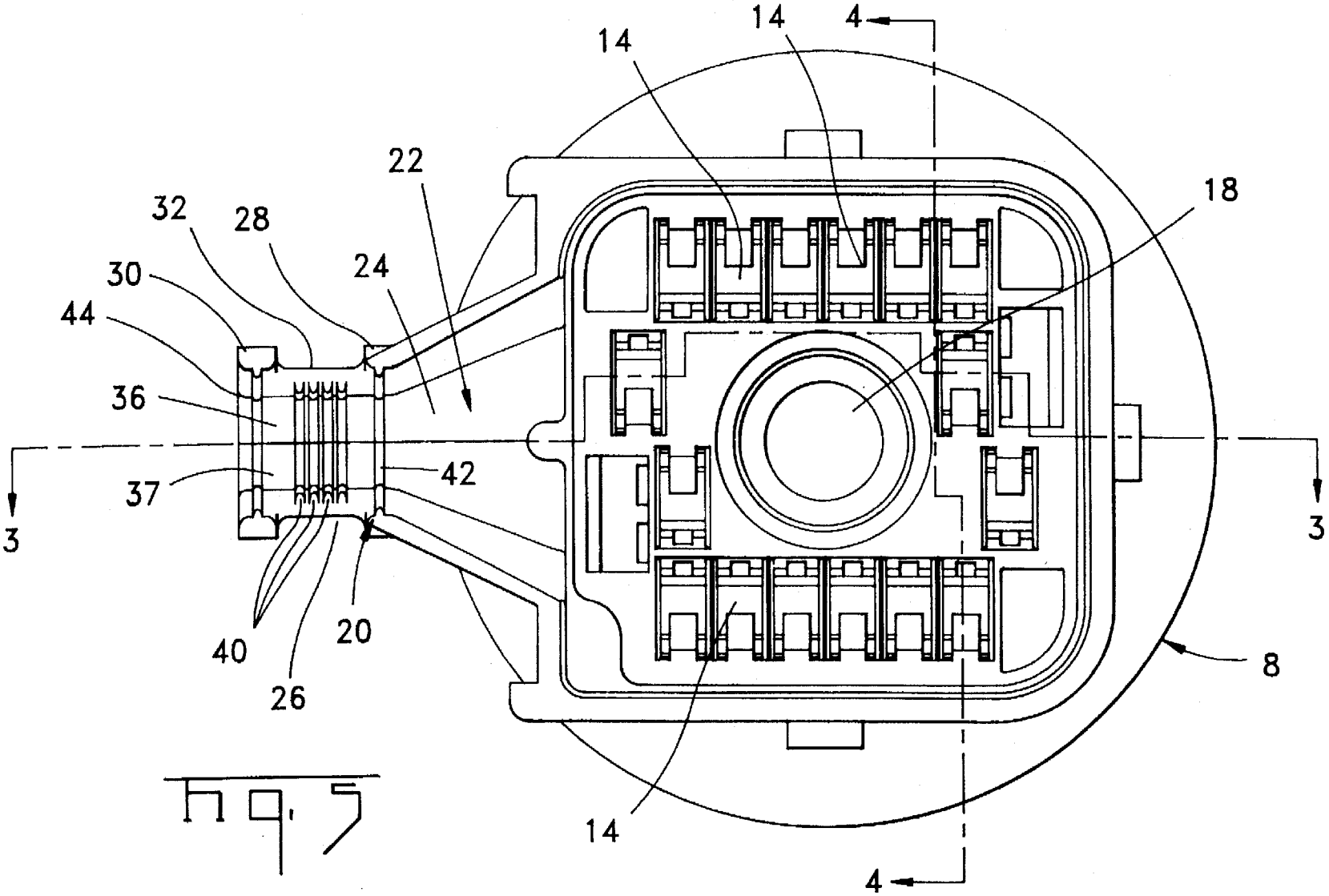
FIG. 5 is a top plan view of the connector body showing the wire restraint arm and the terminal receiving cavities in the connector body. Although

Assembly of the preferred embodiment of the connector 6 on wires 2 in an automotive harness would include the following steps. Since the preferred embodiment of the connector 6 employed in an electronically controlled transmission is a sealed connector, additional components are assembled to the connector body 8 prior to insertion of the terminals 4 into terminal receiving cavities 14. Individual wire seals 19 are inserted in the upper sections of the terminals receiving cavities 14, as shown in FIG. 5, and a seal retainer plate or cap 21 is positioned on top of the seals 19 to hold them in place. Seal cap 21 has a plurality of holes aligned with the terminals receiving cavities 14. Next the bolt 54 is inserted into the bore 18 and secured to the body by a snap ring. This connector subassembly can now be shipped to a harness assembly site.

In the next step, the terminals 4 would be crimped to the ends of insulated wires 2 using conventional application equipment. Afterwards, the terminals 4 would be inserted into the terminal receiving cavities 14 of the connector body 8. The terminals 4 are inserted through the holes in the seal cap 21 and through internal seals 19 into aligned terminal receiving cavities 14. A cantilever latch beam 15 located at the bottom of each terminal receiving cavity engages a surface on the receptacle contact portion 46 to prevent withdrawal of the terminals 4. A terminal position assurance member can be used to back up this resilient cantilever latch beam 15. The receptacle portions 46 at the lower end of the terminals 4 are now firmly held in the connector body 8.

Figure 8:
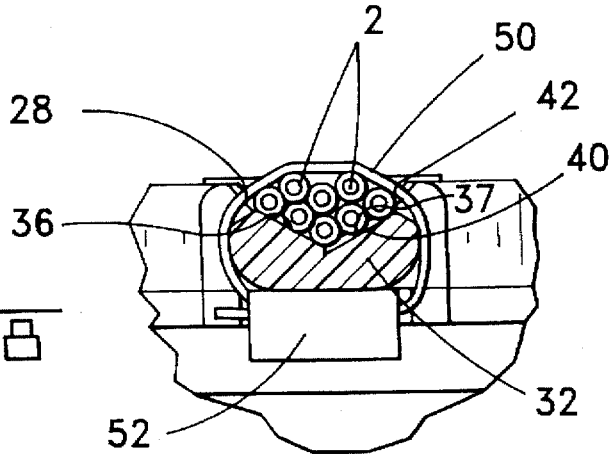
FIG. 8 is a sectional view similar to FIG. 6, showing wires positioned in the wire restraint section.

At this point the assembly process can follow two different sequences. In the first sequence, the wires 2 extending from the terminals 4 through the seal cap 21 can be gathered into a bundle and positioned on the wire restraint arm 20. The funnel section 22 provides space for these wires 2, initially extending from different locations along the planar seal plate 21, into a tighter bundle. The wires 2 emerge from the funnel section in a bundle with some of the wires 2 positioned above other wires. This bundle of wires 2 is then placed on the upwardly facing concave or inclined or V-shaped exposed upper surface of the wire restraint arm 20 and a wire tie 50 is positioned around the wires 2 and the central arm section 32. The end of the wire tie 50 is laced though a wire tie clasp section and tightened causing the wires in contact with the exposed upper surface of the wire restraint arm 20 to engage the ribs 40, 42, 44. The cable tie 50 engages the wires 2 located on the top of the bundle as shown in FIG. 8, so that wires 2 on the outside of the wire bundle are in direct contact with either ribs 40, 42, 44 or with the cable tie 50. The wire tie also engages the bottom of the central wire securing section 32 of the wire restraint arm 20 and it engages the upper beveled surfaces 39 on the top of section 32. As shown in FIG. 8, only the relatively few wires on the interior of the bundle do not directly engage these securing surfaces and since the wire tie 50 can be tightly cinched, movement of any interior wires is also restricted. Since the lips 28 and 30 are wider than the central wire restraint section 32 and extend above this central section, a gap 26 is formed around at least a portion of the central wire restraint section and this gap provides clearance for the wire tie 50. Lips 28 and 30 on opposite ends of gap 26 prevent movement of the cable tie 50 longitudinally relative to the wire restraint arm 20.

In this first assembly sequence a cover 56 can be positioned on top of the connector body 8 after the wires 2 have been secured to the wire restraint arm 20. Cover 50 is snapped to the connector body The connector 20 is then ready to be mounted in a bore of a casting in the electronically controlled transmission. External seals 17 are located in seal grooves 16 on the exterior of the connector body 8, and these seals engage the opening into which the connector 6 is inserted. The bolt 52 can include inner tapered threads to engage a screw on the external electronic component to which connector 6 is mated and the receptacle sections 46 of the terminal 4 are brought into engagement with the mating pins 58 in the external component by rotation of the bolt 52. Since the terminals 4 are secured by the cantilever latch 15 the terminals will not be forced upwardly during mating and the receptacle sections 46 should be aligned with the pins 58 inserted into the terminal receiving cavities 14. The wire restraint prevents vibration or other movement from being transferred to the electrical interface between the terminal receptacle sections 46 and the pins 58 when the connector is in use as part of an electrical system. However, the wire restraint does not prevent the terminals 4 from floating in the terminal cavities 14 due to such factors as heat buildup encountered in automotive applications.

The wires 2 can be secured to the connector 4 in a second alternative assembly sequence. In this second assembly sequence, the cover 56 can be mounted on the connector body 8 prior to positioning the wires into a bundle and attachment to the wire restraint arm 20. The cover 56 is open on the side adjacent to the wire restraint arm 20 permitting the wires to extend though this opening between the cover 56 and the funnel section 22. An operator can choose either sequence.

The manner in which the wires 2 are secured to the wire restraint arm 20 offers one other practical advantage. This connector 6 can be used in a number of applications some of which do not require that the connector 6 be fully loaded. In this case fewer than the maximum number of wires 2 would be used and therefore the wire bundle would be smaller. The manner in which the wires 2 are restrained in this connector permits wire bundles of different sizes to be adequately secured against movement due to wire vibration or external forces. Wires of different diameters can also be accommodated. In the preferred embodiment, this connector can be used when fully loaded with wires having a maximum insulation outer diameter of 2.06 mm. and in applications in which only half that number of wires having an outer diameter of 1.2 .mm would be required. In each case the wires would be adequately restrained.

The representative embodiment of this invention is for use in one particular automotive application. However, this invention could also be used for other applications and with different electrical connectors. For example, the wire restraint arm extends transversely to the terminals of this embodiment, but this orientation may not be necessary in other connectors that use a wire restraint arm of this type. It is anticipated, however, that this invention could prove especially useful in other application using wires to transmit signal level currents. Therefore this invention as defined by the following claims is not limited to the representative embodiment depicted herein.

We claim:

1. A wire restraint on an electrical connector for securing wires extending from the electrical connector, the wire restraint comprising:

an arm extending in a first direction from a connector body, the arm including a central section having a concave surface to engage the wires therein, the concave surface having at least one rib extending transverse to the first direction, the concave surface on the central section having a V-shape;

a first lip between the connector body and the central section, the first lip extending transversely beyond the central section, the first lip including a first surface merging with the concave surface on the central section; and a second lip at an opposite end of the central section from the first lip, the second lip extending laterally beyond the central section so that a gap is formed between the first and second lips on at least one side of the central section, the second lip also including a second surface merging with the concave surface of the central section, whereby wires extending from the connector can be positioned along the concave surface and along the first and second merging surfaces on the first and second lip and a wire tie encircling the central section and wires located on the concave surface is positioned in the gap between the first and second lips with each rib on the concave surface engaging wires positioned in contact therewith so that the ribs and the wire tie prevent movement of the wires relative to the connector when the portion of the wires extending beyond the wire restraint is vibrated or when an external force is applied to the wires.

2. The wire restraint of claim 1 wherein the first and second lips extend above the central section.

3. The wire restraint of claim 1 wherein at least one transverse rib extends above the first merging surface of the first lip and at least one transverse rib extends above second merging surface of the second lip.

4. The wire restraint of claim 1 wherein the first and second merging surfaces are also V-shaped.

5. The wire restraint of claim 4 wherein the slope of the V-shaped merging surfaces is greater than the slope of the V-shaped surface on the central section.

6. The wire restraint of claim 1 wherein multiple ribs are formed on the central section.

7. The wire restraint of claim 1 wherein the arm includes a funnel section between the connector body and the first lip for gathering wires extending from the connector body.

8. The wire restraint of claim 7 wherein the funnel section is inwardly tapered and includes a V-shaped lower surface merging with the first merging surface on the first lip.

9. The wire restraint of claim 1 wherein wires are to be positioned on the upper surface of the wire restraint, with the upper surface and wires positioned thereon being exposed so that the wire tie can be positioned around the wires and the central section with wires on the exterior of the bundle being in engagement with either a rib or the wire tie.

10. An electrical connector for connecting wires to an electrical component, the connector comprising a connector body and a plurality of electrical terminals positioned in terminal receiving cavities in the connector body, the connector body including a wire securing arm extending from one side of the connector body, the wire securing arm including an exposed surface shaped to gather the wires extending from the terminals into a bundle, the wire securing arm including a wire securing section having a width less than the width of other portions of the wire securing arm but greater than the maximum width of any wire bundle extending from the connector body, the wire securing arm having a V-shaped wire securing portion to engage the wires, so that a wire tie wrapped around the wire bundle and the wire securing section secures the wires to the wire securing arm, and so that wire bundles containing different numbers of wires can be positioned on the wire securing arm.

11. The electrical connector of claim 10 further including a cover, the wire securing arm extending beyond the cover so that the cover does not overlap the exposed surface and the wire securing section on the wire securing arm.

12. The electrical connector of claim 11 wherein at least one rib is located on the exposed surface in the wire securing section, the rib and the wire tie engaging wires in the wire bundle to prevent movement of the wires.

13. The electrical connector of claim 10 wherein the wire securing section includes inwardly inclined portions having ribs extending outwardly from a central vertex.

14. The electrical connector of claim 10 in which the terminals extend from a lower connector mating section toward an upper wire entry section, the wire securing arm being located adjacent the wire entry section.

15. The electrical connector of claim 14 wherein the wire securing arm extends transversely relative to the terminals.

16. An electrical connector for use with an electronically controlled system in the vibratory environment of an automobile, wherein the electrical connector is employed to connect wires to corresponding pins extending from an electronic component with which the electrical connector is mated, and wherein the electrical connector comprises:

a plurality of electrical terminals, each terminal including a receptacle section for mating with a corresponding pin in the mating electronic component, and a wire contact section;

a connector body having a plurality of terminal receiving cavities extending from the top of the connector body to the bottom of the connector body, the connector body including means for securing the receptacle sections of individual terminals in individual terminal receiving cavities, the terminals being positioned in the terminal receiving cavities so that the wires extend from the top of the terminal receiving cavities; and a wire restraint arm extending from one side of the connector body adjacent the top of the connector body, the wire restraint arm extending transversely relative to the terminal receiving cavities and relative to the terminals positioned therein, the wire restraint arm being tapered to position the wires in a bundle along the top of an intermediate section of the wire restraint arm around which a wire tie can be positioned, the upper surface of the intermediate section including a V-shaped section for engaging a portion of the wires positioned thereon with the wire tie engaging other wires located on the top of the wire bundle so that the wires in the bundle are held in place along the wire restraint arm so that vibration of the wires in not transmitted to the terminals to which the wires are attached and an electrical interface formed between the receptacle section of each terminal and the corresponding mating pin is not disturbed.

17. The electrical connector of claim 16 wherein the means for engaging a portion of the wires positioned on the intermediate section includes a grooved upper surface having ribs extending transversely relative to the wire restraint arm and to the wires positioned thereon.

18. The electrical connector of claim 17 further including a cover attached to the top of the connector body with the wire restraint arm extending transversely beyond the cover.

* * * * *